US007476645B2

(12) United States Patent
Rosenbaum et al.

(10) Patent No.: US 7,476,645 B2
(45) **Date of Patent: *Jan. 13, 2009**

(54) POLYALPHAOLEFIN AND FISCHER-TROPSCH DERIVED LUBRICANT BASE OIL LUBRICANT BLENDS

(75) Inventors: John M. Rosenbaum, Richmond, CA (US); Brent K. Lok, San Francisco, CA (US); Joseph M. Pudlak, Vallejo, CA (US); James N. Ziemer, Martinez, CA (US); Robert J. Farina, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 431 days.

This patent is subject to a terminal disclaimer.

(21) Appl. No.: 11/069,976

(22) Filed: Mar. 3, 2005

(65) Prior Publication Data

US 2006/0199743 A1 Sep. 7, 2006

(51) Int. Cl.

| | |
|---|---|
| ***C10G 71/00*** | (2006.01) |
| ***C10G 73/02*** | (2006.01) |
| ***C10G 67/00*** | (2006.01) |
| ***C10M 169/04*** | (2006.01) |

(52) U.S. Cl. ..... 508/110; 208/18; 208/19; 208/27; 208/97; 208/950

(58) Field of Classification Search ..... 508/110; 208/18, 19, 27, 97, 950

See application file for complete search history.

(56) References Cited

U.S. PATENT DOCUMENTS

| | | | | |
|---|---|---|---|---|
| 3,773,650 | A | 11/1973 | Hislop et al. | |
| 3,775,288 | A | 11/1973 | Eagen et al. | |
| 3,852,207 | A | 12/1974 | Stangeland et al. | |
| 3,904,513 | A | 9/1975 | Fischer et al. | |
| 4,157,294 | A | 6/1979 | Iwao et al. | |
| 4,347,121 | A | 8/1982 | Mayer et al. | |
| 4,440,871 | A | 4/1984 | Lok et al. | |
| 4,477,333 | A | 10/1984 | Hafez | |
| 4,568,663 | A | 2/1986 | Mauldin | |
| 4,673,487 | A | 6/1987 | Miller | |
| 4,810,357 | A | 3/1989 | Chester et al. | |
| 4,943,424 | A | 7/1990 | Miller | |
| 5,135,638 | A | 8/1992 | Miller | |
| 5,158,665 | A | 10/1992 | Miller | |
| 5,282,958 | A | 2/1994 | Santilli et al. | |
| 6,008,164 | A | 12/1999 | Aldrich et al. | |
| 6,080,301 | A | 6/2000 | Berlowitz et al. | |
| 6,165,949 | A | 12/2000 | Berlowitz et al. | |
| 6,333,298 | B1 | 12/2001 | Waddoups et al. | |
| 6,412,468 | B1 | 7/2002 | Pudelski et al. | |
| 7,045,055 | B2 * | 5/2006 | Ziemer et al. | 208/18 |
| 2004/0094453 | A1 | 5/2004 | Lok et al. | |
| 2005/0077208 | A1 | 4/2005 | Miller | |
| 2005/0077209 | A1 | 4/2005 | Miller | |
| 2005/0133407 | A1 | 6/2005 | Abernathy et al. | |
| 2005/0133408 | A1 | 6/2005 | Abernathy et al. | |
| 2005/0133409 | A1 | 6/2005 | Abernathy et al. | |
| 2006/0172898 | A1 * | 8/2006 | Roby et al. | 508/485 |

FOREIGN PATENT DOCUMENTS

| | | | |
|---|---|---|---|
| EP | 0 609 079 | A1 | 8/1994 |
| WO | WO 00/14188 | | 3/2000 |
| WO | WO 02/064710 | A2 | 8/2002 |
| WO | WO 02/064711 | A1 | 8/2002 |
| WO | WO 02/070629 | A1 | 9/2002 |
| WO | WO 02/070636 | A1 | 9/2002 |

OTHER PUBLICATIONS

U.S. Appl. No. 11/069,979 "Polyalphaolefin & Fischer-Tropsch Derived Lubricant Base Oil Lubricant Blends", filed Mar. 3, 2005, Inventors Rosenbaum et al.

Wedlock, D. J., "Changes in the Quality of Base Oils", *Proceedings of the 8th Annual Fuels & Lubes Asia Conference and Exhibition* (2002).

Henderson, H.Ernest., "Fischer-Tropsch Gas to Liquids-Performance Beyond Current Synthetics", Base Oils and Petroleum Conference, The Americas, Dec. 7, 2001.

Kramer, D.C., et al., "Influence of Group II & III Base Oil Composition on VI and Oxidation Stability", *NLGI* 63(10):20-39 (1999).

Gatto, V.J., et al., "The Influence of Chemical Structure on the Physical Properties and Antioxidant Response of Hydrocracked Base Stocks and Polyalphaolefins", *J. Synthetic Lubrication* 19(1):3-18 (2002).

Barrer, R.M. *Zeolites, Science and Technology*, Ed. F. Ramoa Ribeiro, F.R. Rodrigues, L.D. Rollman, and C. Naccache, NATO ASI Series, Martinus Nijhoff Publishers, Boston, pp. 74-76 (1984).

Baerlocher, Ch., et al., "Atlas of Zeolite Framework Types", Fifth Revised Ed. Elsevier, New York, pp. 10-15 (2001).

Breck, *Zeolite Molecular Sieves*, Chapter 8, pp. 593-724, John Wiley & Sons, New York (1974).

Anderson, et al., "Reactions on ZSM-5-Type Zeolite Catalysts", *J. Catalysis* 58:114-130 (1979).

Gruse, W., et al., *Chemical Technology of Petroleum*, 3rd Edition, McGraw-Hill Book Company, Inc., New York, pp. 566 to 571 (1960).

Freerks, Robert L. et al. "North American Engine Performance of Syntroleum Synthetic Fluids", *Proceedings of the 8th Annual Fuels & Lubes Asia Conference and Exhibition* (2002).

* cited by examiner

*Primary Examiner*—Glenn Caldarola
*Assistant Examiner*—Jim Goloboy
(74) *Attorney, Agent, or Firm*—Crowell & Moring LLP

(57) ABSTRACT

Blended lubricant base oils and blended finished lubricants comprising ≧70 weight percent Fischer-Tropsch derived lubricant base oils comprising ≧6 weight % molecules with monocycloparaffinic functionality and less than 0.05 weight % molecules with aromatic functionality; at least one polyalphaolefin lubricant base oil with a kinematic viscosity at 100° C. greater than about 30 cSt and less than 150 cSt are provided. These blended lubricant base oils and blended finished lubricants exhibit superior friction and wear properties, in addition to other highly desired properties. Also provided are processes for making these blended lubricant base oils and blended finished lubricants.

25 Claims, No Drawings

POLYALPHAOLEFIN AND FISCHER-TROPSCH DERIVED LUBRICANT BASE OIL LUBRICANT BLENDS

The present invention is directed to blended lubricants and blended finished lubricants comprising a Fischer-Tropsch derived lubricant base oil and at least one polyalphaolefin lubricant base oil and processes for making the same. The blended finished lubricants require surprisingly less anti-wear additives to achieve acceptable wear performance than required for Fisher-Tropsch derived lubricant base oils in the absence of at least one polyalphaolefin (PAO) lubricant base oil.

BACKGROUND OF THE INVENTION

High performance automotive and industrial lubricants are in demand. Accordingly, lubricant manufacturers must provide finished lubricants that exhibit high performance properties. To produce these finished lubricants lubricant manufacturers are seeking higher quality lubricant base oil blend stocks. Performance characteristics that are significant include additive solubility, deposit control, and lubricity.

A growing source of these high quality lubricant base oil blend stocks is synthetic lubricants. Synthetic lubricants include Fischer-Tropsch derived lubricant base oils and polyalphaolefins. Polyalphaolefins are synthetic lubricant base oils produced by a chemical polymerization process. However, these lubricant base oils are expensive to produce. In the search for high performance lubricants, attention has recently been focused on Fischer-Tropsch derived lubricants. Although Fischer-Tropsch derived lubricant base oils are desirable for their biodegradability and low amounts of undesirable impurities such as sulfur, the Fischer-Tropsch derived lubricants generally do not exhibit desirable wear performance, lubricity, and deposit performance. Although it is well known in the art to improve these performance characteristics through the use of additives, these additives are generally expensive and thus, can significantly increase the cost of the lubricant base oil. In addition, engine manufacturers worldwide are considering low sulfur and phosphorus limits on engine oils and additives because it is believed that these limits will provide the safe margins for operation of aftertreatment hardware. Antiwear additives often contain significant amounts of both sulfur and phosphorus. Therefore, it is desirable to produce lubricant base oils with high performance characteristics without the significant use of expensive additives, or with reduced amounts of additives that contain sulfur and phosphorus.

It is well known in the art to produce synthetic lubricants and there have been many developmental attempts at producing synthetic lubricants with high performance characteristics. By way of example, U.S. Pat. No. 6,008,164; U.S. Pat. No. 6,080,301; U.S. Pat. No. 6,165,949; WO 00/14188; WO 02/064710 A2; WO 02/064711 A1; WO 02/070629 A1; and WO 02/070636 A1 are directed to synthetic lubricant compositions and methods for producing the lubricating base stocks.

There has also been research into the properties of hydrocracked base stocks and polyalphaolefins. "The Influence of Chemical Structure on the Physical Properties and Antioxidant Response of Hydrocracked Base Stocks and Polyalphaolefins," by V. J. Gatto et al., J. Synthetic Lubrication 19-1, April 2002 (19), 3-18, discloses the effect of hydrocracked base stock chemical composition on lubricant properties, oxidation performance, and antioxidant additive response. In this study fifteen hydrocracked base stocks and polyalphaolefins were analyzed.

In spite of the above research into synthetic lubricants, there remains a need for synthetic lubricants comprising Fischer-Tropsch derived lubricant base oils that exhibit high performance including improved friction and wear properties, without requiring the addition of large amounts of additives to achieve this high performance.

SUMMARY OF THE INVENTION

It has been discovered that the blended lubricant base oils and blended finished lubricants of the present invention, comprising Fischer-Tropsch lubricant base oils and polyalphaolefins, exhibit improved friction and wear properties with reduced amounts of anti-wear additives.

In one embodiment, the present invention relates to a process for making a blended lubricant. The process comprises synthesizing at least one Fischer-Tropsch derived lubricant base oil comprising ≧6 weight % molecules with monocycloparaffinic functionality and less than 0.05 weight % molecules with aromatic functionality; providing at least one polyalphaolefin lubricant base oil with a kinematic viscosity at 100° C. greater than about 30 cSt and less than 150 cSt; and blending the at least one Fischer-Tropsch derived lubricant base oil and the at least one polyalphaolefin lubricant base oil.

In another embodiment, the present invention relates to a process for making a blended finished lubricant. The process comprises performing a Fischer-Tropsch synthesis to provide a product stream and isolating from the product stream a substantially paraffinic wax feed. The substantially paraffinic wax feed is hydroisomerized using a shape selective intermediate pore size molecular sieve comprising a noble metal hydrogenation component under conditions of about 600° F. to 750° F. and an isomerized oil is isolated. The isomerized oil is hydrofinished to provide a Fischer-Tropsch derived lubricant base oil comprising ≧6 weight % molecules with monocycloparaffinic functionality and less than 0.05 weight % molecules with aromatic functionality. At least one polyalphaolefin lubricant base oil having a kinematic viscosity at 100° C. greater than about 30 cSt and less than 150 cSt is provided and the at least one Fischer-Tropsch derived lubricant base oil is blended with the at least one polyalphaolefin lubricant base oil, and an effective amount of at least one anti-wear additive to provide a blended finished lubricant.

In yet another embodiment, the present invention relates to a process for manufacturing a blended finished lubricant including first site and second site remote from the first site. The process comprises manufacturing at the first site at least one Fischer-Tropsch derived lubricant base oil comprising ≧6 weight % molecules with monocycloparaffinic functionality and less than 0.05 weight % molecules with aromatic fiuctionality. The Fischer-Tropsch derived lubricant base oil is received at the second site remote from the first site, the Fischer-Tropsch derived lubricant base oil is blended with at least one polyalphaolefin lubricant base oil having a kinematic viscosity at 100° C. greater than about 30 cSt and less than 150 cSt and an effective amount of at least one anti-wear additive at the second site.

DETAILED DESCRIPTION OF THE INVENTION

Finished lubricants comprise at least one lubricant base oil and at least one additive. Lubricant base oils are the most important component of finished lubricants, generally comprising greater than 70% of the finished lubricants. Finished lubricants may be used in automobiles, diesel engines, axles, transmissions, and industrial applications. Finished lubricants must meet the specifications for their intended application as defined by the concerned governing organization.

A Fischer-Tropsch derived lubricant base oil is a base oil derived at least in part from a Fischer-Tropsch process. The blended lubricants according to the present invention comprise at least one Fischer-Tropsch derived lubricant base oil comprising ≧6 weight % molecules with monocycloparaffinic functionality and less than 0.05 weight % molecules with aromatic functionality, and at least one polyalphaolefin lubricant base oil having a kinematic viscosity greater than about 30 cSt and less than 150 cSt at 100° C. The blended finished lubricants of the present invention comprise at least one Fischer-Tropsch derived lubricant base oil comprising ≧6 weight % molecules with monocycloparaffinic functionality and less than 0.05 weight % molecules with aromatic functionality; at least one polyalphaolefin lubricant base oil having a kinematic viscosity at 100° C. greater than about 30 cSt and less than 150 cSt, and an effective amount of at least one antiwear additive. The blended finished lubricants of the present invention exhibit exceptional friction and wear properties. Preferably, the blended lubricant base oil comprises ≧70 weight percent Fischer-Tropsch derived lubricant base oil.

In general, the effective amount of anti-wear additive needed in a finished lubricant comprising a Fischer-Tropsch derived lubricant base oil is less than that required in a finished lubricant comprising a conventional petroleum lubricant base oil or a polyalphaolefin lubricant base oil. According to the present invention, it has been surprisingly discovered that significantly less anti-wear additive is required for a finished lubricant comprising a Fischer-Tropsch derived lubricant base oil comprising ≧6 weight % molecules with monocycloparaffinic functionality and less than 0.05 weight % molecules with aromatic functionality blended with a polyalphaolefin lubricant base oil having a kinematic viscosity at 100° C. greater than about 30 cSt and less than 150 cSt than in a finished lubricant comprising a Fischer-Tropsch derived lubricant base oil in the absence of a polyalphaolefin lubricant base oil. Accordingly, in the blended finished lubricants of the present invention, a reduced amount of anti-wear additive is needed. Thus, the blended lubricants of the present invention can be used to make high quality engine oils and other finished lubricants meeting the most stringent modern engine oil specifications.

An effective amount of at least one anti-wear additive means the amount of anti-wear additive that reduces the wear volume below the plane in the HFRR test of this invention by at least 1,000 microns$^3$ compared to the wear volume below the plane in the absence of the additive. Preferably the effective amount of at least one anti-wear additive means the amount of anti-wear additive in an additive package or individually added to the blended lubricant base oil to provide a finished lubricant with an High Frequency Reciprocating Rig (HFRR) wear volume below the plane with 1000 g applied load of less than 460,000 microns$^3$, preferably less than 350,000 microns$^3$. According to the present invention, preferably an effective amount of at least one anti-wear additive is 0.001 to 5 weight % of the blended finished lubricant. The effective amount of anti-wear additive in the blended finished lubricants of the present invention is less than the effective amount of anti-wear additive required in a lubricant comprising a Fischer-Tropsch derived lubricant base oil with the preferred composition of this invention in the absence of a polyalphaolefin lubricant base oil having a kinematic viscosity greater than about 30 cSt and less than 150 cSt at 100° C. The effective amount of anti-wear additive in the blended finished lubricants of this invention is less than the effective amount of antiwear additive required in a lubricant comprising polyalphaolefin lubricant base oil having a kinematic viscosity of greater than about 30 cSt and less than 150 cSt at 100° C. in the absence of the Fischer-Tropsch derived lubricant base oil of the present invention.

Many finished lubricant specifications include limits on wear. Examples of specifications that include test limits on wear are: API Passenger Car Engine Test Categories SJ and SL; ACEA 2002 European Oil Sequences for Gasoline, Light Duty Diesel, and Heavy Duty Diesel Engines; ASTM D4950 Grease Categories; Cincinnati-Milacron P-68 Hydraulic Fluid Specifications; and General Motors C-4 Automatic Transmission Fluid Specifications.

The blended lubricants and the blended finished lubricants according to the present invention comprise a polyalphaolefin lubricant base oil with a kinematic viscosity of greater than about 30 cSt at 100° C., and less than 150 cSt at 100° C. The polyalphaolefin lubricant base oil may be obtained commercially or synthesized as described in Shubkin, Ronald L. (1993) Polyalphaolefins, in *Synthetic Lubricants and High-Performance Functional Fluids,* and Pernik, Mark G. (2002) Polyalphaolefins, STLE Annual Meeting, Houston Tex., *Synthetic Lubricants Course.* Polyalphaolefin base oils with kinematic viscosities greater than about 30 cSt and less than 150 cSt at 100° C. are commercially available from a number of manufacturers, including Chevron Phillips, British Petroleum, and ExxonMobil.

The blended lubricant base oils and the blended finished lubricants according to the present invention comprise a Fischer-Tropsch derived lubricant base oil comprising ≧6 weight % molecules with monocycloparaffinic functionality, preferably ≧8 weight % molecules with monocycloparaffinic functionality, and even more preferably ≧10 weight % molecules with monocycloparaffinic functionality.

The blended lubricant base oils and the blended finished lubricants according to the present invention comprise a Fischer-Tropsch derived lubricant base oil comprising very low weight percent of molecules with aromatic functionality, a high weight percent of molecules with cycloparaffinic functionality, and a high ratio of weight percent of molecules containing monocycloparaffinic functionality to weight percent of molecules containing multicycloparaffinic functionality (or high weight percent of molecules with monocycloparaffinic functionality and very low weight percents of molecules with multicycloparaffinic functionality), as described in U.S. Ser. No. 10/744389, filed Dec. 23, 2003, U.S. Ser. No. 10/744870, filed Dec. 23, 2003, and U.S. Ser. No. 10/743,932, filed Dec. 23, 2003, herein incorporated by reference in their entirety.

In a preferred embodiment, the blended lubricant base oils and the blended finished lubricants according to the present invention comprise a Fischer-Tropsch derived lubricant base oil comprising a weight percent of molecules with aromatic functionality of less than 0.05, a weight percent of molecules with cycloparaffinic functionality of greater than 10, and a high ratio of weight percent of molecules with monocycloparaffinic functionality to weight percent of molecules with multicycloparaffinic functionality, preferably greater than 15. In another preferred embodiment, the blended lubricant base oils and the blended finished lubricants according to the present invention comprise a Fischer-Tropsch derived lubricant base oil comprising a weight percent of molecules with aromatic functionality less than 0.01, and more preferably less than 0.008.

The Fischer-Tropsch derived lubricant base oils comprising ≧6 weight % molecules with monocycloparaffinic functionality are prepared from the waxy fractions of the Fischer-Tropsch syncrude by a process including hydroisomerization. The Fischer-Tropsch derived lubricant base oils used in the blended lubricants and blended finished lubricants are made by a process comprising performing a Fischer-Tropsch synthesis to provide a product stream; isolating from the product stream a substantially paraffinic wax feed; hydroisomerizing the substantially paraffinic wax feed; isolating an isomerized oil; and optionally hydrofinishing the isomerized oil. From the process, a Fischer-Tropsch derived lubricant base oil comprising ≧6 weight % molecules with monocycloparaffinic functionality and less than 0.05 weight % molecules with aromatic functionality is isolated. The above-recited preferred embodiments of the Fischer-Tropsch derived lubricant base oil also may be isolated from the process. Preferably, the substantially paraffinic wax feed is hydroisomerized using a shape selective intermediate pore size molecular sieve comprising a noble metal hydrogenation component under conditions of about 600° F. to 750° F. Preferred processes for making the Fischer-Tropsch derived lubricant base oils are described in U.S. Ser. No. 10/744,389, filed Dec. 23, 2003, and U.S. Ser. No. 10/744,870, filed Dec. 23, 2003, herein incorporated by reference in their entirety.

According to the present invention, it is desired that the blended lubricant base oils and the blended finished lubricants comprise Fischer-Tropsch derived lubricant base oils containing high weight percents of molecules with cycloparaffinic functionality because cycloparaffins impart additive solubility and elastomer compatibility. Blended lubricant base oils and blended finished lubricants comprising Fischer-Tropsch derived lubricant base oils containing very high ratios of weight percent of molecules with monocycloparaffinic functionality to weight percent of molecules with multicycloparaffinic functionality (or high weight percent of molecules with monocycloparaffinic functionality and extremely low weight percent of molecules with multicycloparaffinic functionality) are also desirable because molecules with multicycloparaffinic functionality reduce oxidation stability, lower viscosity index, and increase Noack volatility. Models of the effects of molecules with multicycloparaffinic functionality are given in V. J. Gatto, et al, "The Influence of Chemical Structure on the Physical Properties and Antioxidant Response of Hydrocracked Base Stocks and Polyalphaolefins," J. Synthetic Lubrication 19-1, April 2002, pp 3-18.

The blended lubricants of the present invention comprise between 70 and about 99 weight % Fischer-Tropsch derived lubricant base oil and about 1 to less than 30 weight % polyalphaolefin lubricant base oil. The blended finished lubricants of the present invention comprise between 70 and about 99 weight % Fischer-Tropsch derived lubricant base oil, between about 1 and 30 weight % polyalphaolefin lubricant base oil, and between 0.001 and 5 weight % anti-wear additive(s). Preferably, the finished lubricant comprises between 0.001 and 4 weight % anti-wear additive(s).

DEFINITIONS

The following terms will be used throughout the specification and will have the following meanings unless otherwise indicated.

The term "derived from a Fischer-Tropsch process" or "Fischer-Tropsch derived," means that the product, fraction, or feed originates from or is produced at some stage by a Fischer-Tropsch process.

Aromatic group means any hydrocarbonaceous compound or group containing at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

Molecules with aromatic functionality mean any molecule that is, or contains as one or more substitutents, an aromatic group.

Molecules with cycloparaffinic functionality mean any molecule that is, or contains as one or more substituents, a monocyclic or a fused multicyclic saturated hydrocarbon group. The cycloparaffinic group may be optionally substituted with one or more, preferably one to three, substituents. Representative examples include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more, preferably one to three, substituents. Representative examples include, but are not limited to, cyclopropyl, cyclobutyl, cyclohexyl, cyclopentyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more, preferably one to three, substituents. Representative examples include, but are not limited to, decahydronaphthalene, octahydropentalene, 3,7,10-tricyclohexylpentadecane, decahydro-1-(pentadecan-6-yl)naphthalene, and the like.

"Compression ignition internal combustion engines" mean diesel engines.

"Internal Combustion Engine" is an engine, such as an automotive gasoline piston engine or a diesel, in which fuel is burned within the engine proper rather than in an external furnace, as in a steam engine. These engines include natural gas engines, diesel engines, and gasoline engines. They may be two-stroke or four-stroke.

"Multigrade internal combustion engine crankcase oil" is a lubricant meeting the specifications of SAE J300, June 2001. The API classifies engine oil according to their SAE viscosity grades. Table I below summarizes the classification.

TABLE I

API Engine Oil Classification

| SAE Viscosity Grade | Maximum Low Temperature Cranking Viscosity, cP | Maximum Low Temperature Pumping Viscosity with No Yield Stress, cP | Minimum Low-Shear-Rate Kinematic Viscosity at 100° C., cSt | Maximum Low-Shear-Rate Kinematic Viscosity at 100° C., cSt | Minimum High-Shear-Rate Viscosity at 150° C., cP |
|---|---|---|---|---|---|
| 0W-__ | 6200 at −35° C. | 60000 at −40° C. | 3.8 | — | — |
| 5W-__ | 6600 at −30° C. | 60000 at −35° C. | 3.8 | — | — |
| 10W-__ | 7000 at −25° C. | 60000 at −30° C. | 4.1 | — | — |
| 15W-__ | 7000 at −20° C. | 60000 at −25° C. | 5.6 | — | — |
| 20W-__ | 9500 at −15° C. | 60000 at −20° C. | 5.6 | — | — |
| 25W-__ | 13000 at −10° C. | 60000 at −15° C. | 9.3 | — | — |
| __W-20 | — | — | 5.6 | 9.3 | 2.6 |
| __W-30 | — | — | 9.3 | 12.5 | 2.9 |
| 0W-40, 5W-40, 10W-40 | — | — | 12.5 | 16.3 | 2.9 |
| 15W-40, 20W-40, 25W-40 | — | — | 12.5 | 16.3 | 3.7 |
| __W-50 | — | — | 16.3 | 21.9 | 3.7 |
| __W-60 | — | — | 21.9 | 26.1 | 3.7 |

An engine oil having a viscosity grade of 0 W has a maximum low temperature cranking viscosity of 6,200 cP at −35° C., a maximum low temperature pumping viscosity with no yield stress of 60,000 cP at −40° C., and a minimum low-shear-rate kinematic viscosity of 3.8 cSt at 100° C.. An engine oil having a viscosity grade of 5 W has a maximum low temperature cranking viscosity of 6,600 cP at −30° C., a maximum low temperature pumping viscosity with no yield stress of 60,000 cP at −35° C., and a minimum low-shear-rate kinematic viscosity of 3.8 cSt at 100° C.. An engine oil having a viscosity grade of 10 W has a maximum low temperature cranking viscosity of 7,000 cP at −25° C., a maximum low temperature pumping viscosity with no yield stress of 60,000 cP at −30° C., and a minimum low-shear-rate kinematic viscosity of 4.1 cSt at 100° C.. An engine oil having a viscosity grade of 15 W has a maximum low temperature cranking viscosity of 7,000 cP at −20° C., a maximum low temperature pumping viscosity with no yield stress of 60,000 cP at −25° C., and a minimum low-shear-rate kinematic viscosity of 5.6 cSt at 100° C..

"Spark ignition internal combustion engines" mean gasoline engines.

"Valve train" in an internal combustion engine consists of valves and a camshaft. Currently, there are two types of designs used in the automobile engine for the placement of the valves and camshaft. If the camshaft is located in the cylinder head, the engine is called an overhead cam design; if the camshaft is located in the engine block, the engine is called an overhead valve design. Both designs have their valves mounted above the cylinders in the cylinder head. It is the location of the camshaft, which operates the valves, that distinguishes the two designs. A dual overhead cam (DOHC) engine has two camshafts on each cylinder head; one camshaft operates the intake valves, while the other one operates the exhaust valves.

"Low-sulfur diesel fuel" has a sulfur content of up to about 0.05% by weight as determined by the test method specified in ASTM D2622-87.

"Low-sulfur gasolines" have sulfur contents below about 300 ppm, or 0.03%.

The blended lubricant base oils and blended finished lubricants according to the present invention exhibit desirable properties in addition to exceptional friction and wear properties, including high viscosity indexes, low Noack volatility, excellent oxidation stability, and low pour points. Further benefits obtained by the use of the finished lubricants of the present invention include improved fuel economy, reduced wear of components of engines, longer oil change intervals, less waste oil for disposal, and reduced high temperature deposits.

Oxygen Stability Tests:

Oxidation stability was determined using two different test methods, Oxidator BN and Oxidator B with L-4 Catalyst. Oxidator BN was used to determine oxygen stability of the Fischer-Tropsch derived lubricant base oils, which do not contain any additives. A convenient way to measure the stability of lubricant base oils is by the use of the Oxidator BN Test, as described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricant base oil in a simulated application. High values, or long times to absorb one liter of oxygen, indicate good oxidation stability. Traditionally it is considered that the Oxidator BN should be above 7 hours. For the present invention, the Oxidator BN value will be greater than about 30 hours, preferably greater than about 40 hours.

Oxidator B was used to determine oxygen stability of the blended finished lubricants, which already contained an antioxidant additive. The Oxidator B with L-4 Catalyst Test is a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., reporting the hours to absorption of 1000 ml of $O_2$ by 100 g of oil. In the Oxidator B with L-4 Catalyst test, 0.8 ml of catalyst is used per 100 grams of oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The Oxidator B with L-4 Catalyst Test measures the response of a finished lubricant in a simulated application. High values, or long times to adsorb one liter of oxygen, indicate good stability. Generally, the Oxidator B with L-4 Catalyst Test results should be above about 7 hours. Preferably, the Oxidator B with L-4 value will be greater than about 10 hours. The blended finished blends of the present invention have results much greater than 10 hours. Preferably, the blended finished lubricants of the present invention have an Oxidator B with L-4 Catalyst test result of greater than 22 hours, even more preferably greater than 30 hours.

HFRR Wear Tests:

Wear tests were conducted on 1 ml oil samples using a High Frequency Reciprocating Rig (HFRR) (PCS Instruments HFR2) using SAE-AISI E-52100 6.00 mm diameter through-hardened balls (Grade 24 per ANSI B3.12, having a Rockwell hardness "C" scale number of 58-66, in accordance with the Test Method ASTM E 18, and a surface finish of less than 0.05 microns RA); on polished SAE-AISI E-52100 10 mm flat disks, having a Vickers hardness "HV 30", in accordance with Specification E 92, a Rockwell hardness "C" scale number of 190-210, turned, lapped, and polished to a surface finish of less than 0.02 microns RA. AISI E-52100 is a ferrous alloy with a typical elemental composition of: Carbon, 1.00%; Manganese, 0.35%; Silicon, 0.25%; and Chromium, 1.50%. The test conditions were as follows: frequency 20 Hz; applied load 1,000 g; stroke length lmm; fluid temperature 120° C., relative humidity greater than 30%, and test duration 200 minutes. The test is a modified version of that described in ASTM D 6079.

Because of the extreme hardness differences between the balls and disks, most of the material wear occurred on the disks in the form of a 1 mm long hemispherical wear track. Consequently, anti-wear performances were based solely on the amount of material removed from the disks, and not the balls. Disk wear volume measurements were made after first removing fine wear debris from the surface of the disk with a cotton swab immersed in hexane and then profiling a 1/24 mm×1.64 mm rectangular area of the surface in the vicinity of the wear scar with a MicroXAM-100 3D Surface Profiler (ADE Phase Shift). A distinction was made between the volume of material removed by adhesion (lubricant released wear) from that displaced by abrasion (plowing) by first leveling the disk's surface profile based on the flat regions immediately adjacent to the wear scar using the MicroXAM's software leveling routine, and then subtracting the volume of metal protruding above the plane of the surface (abrasive) from the void volume extending below the plane of the surface (adhesive). The HFRR wear volumes from the void volume extending below the plane of the surface and the HFRR net wear scar volumes were reported as HFRR Wear Volume Below the Plane and HFRR Net Wear Volume, respectively, in cubic microns. The volume precision measurement by this technique is estimated to be ±10 microns$^3$. All lubricants were tested in duplicate and the results averaged.

Preferably, the finished lubricants of the present invention exhibit an HFRR wear volume below the plane with 1,000 g applied load of less than 300,000 microns$^3$, more preferably less than or equal to about 170,000 microns$^3$, even more preferably less than 150,000 microns$^3$, and even more preferably less than 110,000 microns$^3$. In addition, the finished lubricants of the present invention exhibit a HFRR Net Wear Volume less than 100,000 microns$^3$, preferably less than 50,000 microns$^3$, and more preferably less than 25,000 microns$^3$.

Other Lubricant Tests:

Kinematic viscosity is a measurement of the resistance to flow of a fluid under gravity. Many lubricant base oils, finished lubricants made from them, and the correct operation of equipment depends upon the appropriate viscosity of the fluid being used. Kinematic viscosity is determined by ASTM D 445-01. The results are reported in centistokes (cSt ). The blended finished lubricants of the present invention have a kinematic viscosity of between about 2.0 cSt and about 20 cSt at 100° C..

Viscosity Index (VI) is an empirical, unitless number indicating the effect of temperature change on the kinematic viscosity of the oil. Liquids change viscosity with temperature, becoming less viscous when heated; the higher the VI of an oil, the lower its tendency to change viscosity with temperature. High VI lubricants are needed wherever relatively constant viscosity is required at widely varying temperatures. VI may be determined as described in ASTM D 2270-93. Preferably, the blended finished lubricants of the present invention have a viscosity index of greater than 140, more preferably greater than 165.

Pour point is a measurement of the temperature at which a sample of lubricant base oil will begin to flow under carefully controlled conditions. Pour point may be determined as described in ASTM D 5950-02. The results are reported in degrees Celsius. Many commercial lubricant base oils have specifications for pour point. When lubricant base oils have low pour points, they also are likely to have other good low temperature properties, such as low cloud point, low cold filter plugging point, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95

Noack volatility is defined as the mass of oil, expressed in weight %, which is lost when the oil is heated at 250° C. and 20 mmHg (2.67 kPa; 26.7 mbar) below atmospheric in a test crucible through which a constant flow of air is drawn for 60 minutes, according to ASTM D5800. A more convenient method for calculating Noack volatility and one which correlates well with ASTM D5800 is by using a thermo gravimetric analyzer test (TGA) by ASTM D6375. TGA Noack volatility is used throughout this disclosure unless otherwise stated. Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. Preferably, the blended finished lubricants of the present invention have a Noack volatility of less than 12 weight %.

Cold-cranking simulator apparent viscosity (CCS VIS) is a test used to measure the viscometric properties of lubricant base oils under low temperature and high shear. CCS VIS may also be referred to as low temperature cranking viscosity. The test method to determine CCS VIS is ASTM D 5293-02, at a set temperature between −5 and −35° C. Results are reported in centipoise, cP. CCS VIS has been found to correlate with low temperature engine cranking. Specifications for maximum CCS VIS are defined for automotive engine oils by SAE J300, revised in June 2001.

High Temperature High Shear rate viscosity (HTHS) measures a fluid's resistance to flow under conditions resembling highly-loaded journal bearings in fired internal combustion engines, typically 1 million $s^{-1}$ at 150° C. HTHS is a better indication of how an engine operates at high temperature with a given lubricant than kinematic low shear rate viscosities at 100° C. HTHS directly correlates to the oil film thickness in a bearing. SAE J300 June '01 contains the current specifications for HTHS measured by ASTM D 4683, ASTM D 4741, or ASTM D 5481.

Mini-Rotary Viscometer (MRV) relates to the mechanism of pumpability and is a low shear rate measurement. MRV is measured by ASTM D 4684, and may also be referred to as low temperature pumping viscosity. Slow sample cooling rate is the method's key feature. A sample is pretreated to have a specified thermal history which includes warming, slow cooling, and soaking cycles. MRV measures an apparent yield stress, which, if greater than a threshold value, indicates a potential air-binding pumping failure problem. Above a certain viscosity, currently defined as 60,000 cP by SAE J 300 June 2001, the oil may be subject to pumpability failure by a mechanism called "flow limited" behavior. An SAE 10 W oil, for example, is required to have a maximum viscosity of 60,000 cP at −30° C. with no yield stress. This method also measures an apparent viscosity under shear rates of 1 to 50 $s^{-1}$.

TEOST MHT is a test that determines the amount of deposits, in mg, formed by automotive engine oils utilizing the thermo-oxidation engine oil simulation test (TEOST) under moderately high temperature conditions. The test method is designed to predict the high temperature deposit forming tendencies of engine oil at the temperature found in the piston-ring belt area (around 300° C.). TEOST MHT can be run on TEOST 33C. bench test units already in the field for ASTM D 6335, with retrofit hardware and modified test conditions. The primary hardware differences are 1) a glass depositor rod casing instead of steel, allowing for viewing of the oxidation/deposit process, 2) wire-wound depositor rods to permit thin-film oil flow over the heated rod, and 3) collection of volatilized material generated in the depositor rod casing during the test. TEOST MHT has a maximum specification of 45 mg total deposits in the newest engine oil service category for automotive gasoline engines. API SL/ILSAC GF-3 oils that give improved high temperature deposit control in this test are expected to provide extended oil drain capability, less abrasive wear, improved piston ring cleanliness, longer engine life, and improved turbocharger performance. A turbocharger is an exhaust driven pump that compresses intake air and forces it into the combustion chambers at higher than atmospheric pressures. The increased air pressure allows more fuel to be burned and results in increased horsepower being produced. Table II summarizes the TEOST MHT protocol.

TABLE II

| TEOST MHT protocol | |
|---|---|
| Test time | 24 hours |
| Temperature | 285° C. |
| Sample size | 10 mL |
| Flow rate (sample) | 0.25 g/min |
| Flow rate (dry air) | 12 mL/min |
| Catalyst | Fe + Pb + Sn |

The blended finished lubricants according to the present invention preferably have a TEOST-MHT total deposit weight of less than or equal to about 45 mg.

Fischer-Tropsch Synthesis

The Fischer-Tropsch derived lubricant base oils comprising ≧6 weight % molecules with monocycloparaffinic functionality and less than 0.05 wt % molecules with aromatic functionality are made by a Fischer-Tropsch process followed by hydroisomerization of the waxy fractions of the Fischer-Tropsch syncrude.

In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guard-beds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, contacting a synthesis gas comprising a mixture of $H_2$ and CO with a Fischer-Tropsch catalyst under suitable temperature and pressure reactive conditions forms liquid and gaseous hydrocarbons. The Fischer-Tropsch reaction is typically conducted at temperatures of about 300-700° F. (149-371° C.), preferably about 400-550° F. (204-228° C.); pressures of about 10-600 psia, (0.7-41 bars), preferably about 30-300 psia, (2-21 bars); and catalyst space velocities of about 100-10,000 cc/g/hr, preferably about 300-3,000 cc/g/hr. Examples of conditions for performing Fischer-Tropsch type reactions are well known to those of skill in the art.

The products of the Fischer-Tropsch synthesis process may range from $C_1$ to $C_{200+}$ with a majority in the $C_5$ to $C_{100+}$ range. The reaction can be conducted in a variety of reactor types, such as fixed bed reactors containing one or more catalyst beds, slurry reactors, fluidized bed reactors, or a combination of different type reactors. Such reaction processes and reactors are well known and documented in the literature.

The slurry Fischer-Tropsch process, which is preferred in the practice of the invention, utilizes superior heat (and mass)

transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g., tail gases through middle distillate fuels), largely in the $C_5$-$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$. Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that is used as a feedstock to the process for providing the Fischer-Tropsch derived lubricant base oil used in the blended lubricants and blended finished lubricants of the present invention.

The Fischer-Tropsch derived lubricant base oils comprising ≧6 weight % molecules with monocycloparaffinic functionality and less than 0.05 weight % molecules with aromatic functionality are prepared from the waxy fractions of the Fischer-Tropsch syncrude by a process including hydroisomerization. Preferably, the Fischer-Tropsch derived lubricant base oils are made by a process as described in U.S. Ser. No. 10/744,389, filed Dec. 23, 2003, and U.S. Ser. No. 10/744,870, filed Dec. 23, 2003, herein incorporated by reference in their entirety. The Fischer-Tropsch derived lubricant base oils used in the blended lubricants and blended finished lubricants of the present invention may be manufactured at a site different from the site at which the components of the blended lubricant are received and blended.

Hydroisomerization

Hydroisomerization is intended to improve the cold flow properties of the lubricant base oil by the selective addition of branching into the molecular structure. Hydroisomerization ideally will achieve high conversion levels of the Fischer-Tropsch wax to non-waxy iso-paraffins while at the same time minimizing the conversion by cracking. Preferably, the conditions for hydroisomerization in the present invention are controlled such that the conversion of the compounds boiling above about 700° F. in the wax feed to compounds boiling below about 700° F. is maintained between about 10 wt % and 50 wt %, preferably between 15 wt % and 45 wt %.

According to the present invention, hydroisomerization is conducted using a shape selective intermediate pore size molecular sieve. Hydroisomerization catalysts useful in the present invention comprise a shape selective intermediate pore size molecular sieve and optionally a catalytically active metal hydrogenation component on a refractory oxide support. The phrase "intermediate pore size," as used herein means an effective pore aperture in the range of from about 3.9 to about 7.1 Å when the porous inorganic oxide is in the calcined form. The shape selective intermediate pore size molecular sieves used in the practice of the present invention are generally 1-D 10-, 11- or 12-ring molecular sieves. The preferred molecular sieves of the invention are of the 1-D 10-ring variety, where 10- (or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

A particularly preferred intermediate pore size molecular sieve, which is useful in the present process is described, for example, in U.S. Pat. Nos. 5,135,638 and 5,282,958, the contents of which are hereby incorporated by reference in their entirety. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 to 6.5 Angstrom with little hindrance.

Hydroisomerization catalysts useful in the present invention comprise a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports, which are conventionally used for catalysts, including silica, alumina, silica-alumina, magnesia, titania and combinations thereof.

The conditions for hydroisomerization will be tailored to achieve a Fischer-Tropsch derived lubricant base oil comprising ≧6 weight % molecules with monocycloparaffinic functionality and less than 0.05 weight % molecules with aromatic functionality. The conditions for hydroisomerization will depend on the properties of feed used, the catalyst used, whether or not the catalyst is sulfided, the desired yield, and the desired properties of the lubricant base oil. Conditions under which the hydroisomerization process of the current invention may be carried out include temperatures from about 600° F. to about 750° F. (315° C. to about 399° C.), preferably about 600° F. to about 700° F. (315° C. to about 371° C.); and pressures from about 15 to 3000 psig, preferably 100 to 2500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr-1, preferably from about 0.1 to about 5 hr-1. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization are described in U.S. Pat. Nos. 5,282,958 and 5,135,638, the contents of which are incorporated by reference in their entirety.

Hydrogen is present in the reaction zone during the hydroisomerization process, typically in a hydrogen to feed ratio from about 0.5 to 30 MSCF/bbl (thousand standard cubic feet per barrel), preferably from about 1 to about 10 MSCF/bbl. Hydrogen may be separated from the product and recycled to the reaction zone.

Hydrotreating

Waxy feed to the hydroisomerization process may be hydrotreated prior to hydroisomerization dewaxing. Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Catalysts used in carrying out hydrotreating operations are well known in the art. See, for example, U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300° F. to about 750° F. (about 150° C. to about 400° C.), preferably ranging from 450° F. to 725° F. (230° C. to 385° C.).

Hydrofinishing

Hydrofinishing is a hydrotreating process that may be used as a step following hydroisomerization to provide the Fischer-Tropsch derived lubricant base oil. Hydrofinishing is intended to improve oxidation stability, UV stability, and appearance of the Fischer-Tropsch derived lubricant base oil product by removing traces of aromatics, olefins, color bodies, and solvents. As used in this disclosure, the term UV stability refers to the stability of the lubricant base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487.

The Fischer-Tropsch derived lubricant base oils of the present invention may be hydrofinished to improve product quality and stability. During hydrofinishing, overall liquid hourly space velocity (LHSV) is about 0.25 to 2.0 $hr^{-1}$, preferably about 0.5 to 1.0 $hr^{-1}$. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Suitable hydrofinishing catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble metal (such as nickel-molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

Clay treating to remove impurities is an alternative final process step to provide Fischer-Tropsch derived lubricant base oils.

Fractionation

Optionally, the process to provide the Fischer-Tropsch derived lubricant base oil may include fractionating the substantially paraffinic wax feed prior to hydroisomerization, or fractionating of the lubricant base oil obtained from the hydroisomerization process. The fractionation of the Fischer-Tropsch substantially paraffinic wax feed or lubricant base oil into distillate fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons may take place leading to fouling of the equipment and to lower yields of the heavier cuts. Vacuum distillation is typically used to separate the higher boiling material, such as the lubricant base oil fractions, into different boiling range cuts. Fractionating the lubricant base oil into different boiling range cuts enables the lubricant base oil manufacturing plant to produce more than one grade, or viscosity, of lubricant base oil.

Solvent Dewaxing

The process to make the Fischer-Tropsch derived lubricant base oil may also include a solvent dewaxing step following the hydroisomerization process. Solvent dewaxing optionally may be used to remove small amounts of remaining waxy molecules from the lubricant base oil after hydroisomerization dewaxing. Solvent dewaxing is done by dissolving the lubricant base oil in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. Solvent dewaxing is also described in U.S. Pat. Nos. 4,477,333, 3,773,650 and 3,775,288.

Fischer-Tropsch Derived Lubricant Base Oil

The Fischer-Tropsch derived lubricant base oil used to prepare the blended lubricants and the blended finished lubricants of the invention preferably have a viscosity of about between about 2 and 20 cSt at 100° C.

The Fischer-Tropsch derived lubricant base oils comprise ≧6 weight % molecules with monocycloparaffinic functionality, preferably ≧8 weight % molecules with monocycloparaffinic functionality, and even more preferably ≧10 weight % molecules with monocycloparaffinic functionality. In a preferred embodiment, the Fischer-Tropsch derived lubricant base oil comprises very low weight percents of aromatics, a high weight percent of molecules with cycloparaffinic functionality, and a high ratio of weight percent of molecules with monocycloparaffinic functionality to weight percent of molecules with multicycloparaffinic functionality (or high weight percent of molecules with monocycloparaffinic functionality and very low weight percents of molecules with multicycloparaffinic functionality). The Fischer-Tropsch derived lubricant base oil comprises a weight percent of molecules with aromatic functionality of less than 0.05, preferably less than 0.02 weight %. In a preferred embodiment, the Fischer-Tropsch derived lubricant base oil comprises a weight percent of molecules with cycloparaffinic functionality of greater than 10, and a high ratio of weight percent of molecules with monocycloparaffinic functionality to weight percent of molecules with multicycloparaffinic functionality, preferably greater than 15. In yet another preferred embodiment, the Fischer-Tropsch derived lubricant base oil comprises a weight percent of molecules with aromatic functionality less than 0.05, a weight percent of molecules with monocycloparaffinic functionality of greater than 10, and a weight percent of molecules with multicycloparaffinic functionality of less than 0.1.

The Fischer-Tropsch derived lubricant base oils used in the blended lubricants and blended finished lubricants contain greater than 95 weight % saturates as determined by elution column chromatography, ASTM D 2549-02. Olefins are present in an amount less than detectable by long duration $C^{13}$ Nuclear Magnetic Resonance Spectroscopy (NMR). Molecules with aromatic functionality are present in an amount of less than 0.05 weight percent by HPLC-UV, and confirmed by ASTM D 5292-99 modified to measure low level aromatics. In preferred embodiments molecules with aromatic functionality are present in an amount less than 0.02 weight percent, preferably less than 0.01 weight percent.

Sulfur is present in an amount less than 25 ppm, more preferably less than 1 ppm, as determined by ultraviolet fluorescence by ASTM D 5453-00.

Aromatics Measurement by HPLC-UV:

The method used to measure low levels of molecules with aromatic functionality in the Fischer-Tropsch derived lubricant base oils uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated Fischer-Tropsch derived lubricant base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with cycloparaffinic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and cycloparaffinic substitution on the ring system. These bathochromic shifts are well known to be caused by alkyl-group delocalization of the $\pi$-electrons in the aromatic ring. Since few unsubstituted aromatic compounds boil in the lubricant range, some degree of red-shift was expected and observed for all of the principle aromatic groups identified.

Quantification of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of molecules with aromatic functionality in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). Al 5-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffinic function is very low in a lubricant base oil, the additive solubility is low and the elastomer compatibility is poor. Examples of base oils with these properties are polyalphaolefins and Fischer-Tropsch base oils (GTL base oils) with less than about 5% cycloparaffins. To improve these properties in finished lubricants, expensive co-solvents such as esters must often be added. Preferably, the Fischer-Tropsch derived lubricant base oils used in the blended lubricants and blended finished lubricants of the present invention comprise a high weight percent of molecules with monocycloparaffinic functionality and a low weight percent of molecules with multicycloparaffinic functionality such that the Fischer-Tropsch derived lubricant base oils, and thus the blended lubricants and blended finished lubricants, have high oxidation stability and high viscosity index in addition to good additive solubility and elastomer compatibility.

The composition of molecules with cycloparaffinic and multicycloparaffinic functionality are determined using Field Ionization Mass Spectroscopy (FIMS). FIMS spectra were obtained on a VG 70VSE mass spectrometer. The samples were introduced via solid probe, which was heated from about 40° C. to 500° C. at a rate of 50° C. per minute. The mass spectrometer was scanned from m/z 40 to m/z 1000 at a rate of 5 seconds per decade. The acquired mass spectra were summed to generate one "averaged" spectrum. Each spectrum was C13 corrected using a software package from PC-MassSpec. FIMS ionization efficiency was evaluated using blends of nearly pure branched paraffins and highly naphthenic, aromatics-free base stock. The ionization efficiencies of iso-paraffins and cycloparaffins in these base oils were essentially the same. Iso-paraffins and cycloparaffins comprise more than 99.9% of the saturates in the lubricant base oils of this invention. Response factors for all compound types were assumed to be 1.0, such that weight percent was given directly from area percent.

The lubricant base oils of this invention are characterized by FIMS into paraffins and molecules with different numbers of unsaturations. The molecules with different numbers of unsaturations may be comprised of cycloparaffins, olefins, and aromatics. As the lubricant base oils of this invention have very low levels of aromatics and olefins, the molecules with different numbers of unsaturations may be interpreted as being cycloparaffins with different numbers of rings. Thus, for the lubricant base oils of this invention, the 1-unsaturations are monocycloparaffins, the 2-unsaturations are dicycloparaffins, the 3-unsaturations are tricycloparaffins, the 4-unsaturations are tetracycloparaffins, the 5-unsaturations are pentacycloparaffins, and the 6-unsaturations are hexacycloparaffins. If aromatics were present in significant amounts in the lubricant base oil they would be identified in the FIMS analysis as 4-unsaturations. The total of the 2-unsaturations, 3-unsaturations, 4-unsaturations, 5-unsaturations, and 6-unsaturations in the white oils of this invention are the weight percent of molecules with multicycloparaffinic functionality. The total of the 1-unsaturations in the lubricant base oils of this invention are the weight percent of molecules with monocycloparaffinic functionality.

In one embodiment, the Fischer-Tropsch derived lubricant base oils have a weight percent of molecules with cycloparaffinic functionality greater than 10, preferably greater than 15, more preferably greater than 20. They have a ratio of weight percent of molecules with monocycloparaffinic functionality to weight percent of molecules with multicycloparaffinic functionality greater than 15, preferably greater than 50, more preferably greater than 100. In preferred embodiments, the Fischer-Tropsch derived lubricant base oils have a weight percent of molecules with monocycloparaffinic functionality greater than 10, and a weight percent of molecules with multicycloparaffinic functionality less than 0.1, or even no molecules with multicycloparaffinic functionality. In this embodiment, the Fischer-Tropsch derived lubricant base oils may have a kinematic viscosity at 100° C. between about 2 cSt and about 20 cSt, preferably between about 2 cSt and about 12 cSt, most preferably between about 3.5 cSt and about 12 cSt.

In another embodiment in the Fischer-Tropsch derived lubricant base oils, there is a relationship between the weight percent of all molecules with at least one cycloparaffinic functionality and the kinematic viscosity of the lubricant base oils of this invention. That is, the higher the kinematic viscosity at 100° C. in cSt, the higher the amount of molecules with cycloparaffinic functionality that are obtained. In a preferred embodiment, the Fischer-Tropsch derived lubricant base oils have a weight percent of molecules with cycloparaffinic functionality greater than the kinematic viscosity in cSt multiplied by three, preferably greater than 15, more preferably greater than 20; and a ratio of weight percent of molecules with monocycloparaffinic functionality to weight percent of molecules with multicycloparaffinic functionality greater than 15, preferably greater than 50, more preferably greater than 100. The Fischer-Tropsch derived lubricant base oils have a kinematic viscosity at 100° C. between about 2 cSt and about 20 cSt, preferably between about 2 cSt and about 12 cSt. Examples of these base oils may have a kinematic viscosity at 100° C. of between about 2 cSt and about 3.3 cSt and have a weight percent of molecules with cycloparaffinic functionality that is high, but less than 10 weight percent.

The modified ASTM D 5292-99 and HPLC-UV test methods used to measure low level aromatics, and the FIMS test method used to characterize saturates are described in D. C. Kramer, et al., "Influence of Group II & III Base Oil Composition on VI and Oxidation Stability," presented at the 1999 AIChE Spring National Meeting in Houston, Mar. 16, 1999, the contents of which is incorporated herein in its entirety.

Although the Fischer-Tropsch wax feeds are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed during the process of this invention by hydrofinishing or by clay treatment.

The properties of the Fischer-Tropsch derived lubricant base oils used in the examples are summarized below in Table III.

TABLE III

| | FTBO Properties | | |
|---|---|---|---|
| | FT-4A | FT-4B | FT-8B |
| Viscosity at 100° C. (cSt) | 3.94 | 4.415 | 7.953 |
| Viscosity Index | 143 | 147 | 165 |
| Pour Point (° C.) | −19 | −12 | −12 |
| FIMS Analysis | | | |
| % Paraffins | 89.0 | 89.1 | 87.2 |
| % Monocycloparaffins | 11.0 | 10.9 | 12.6 |
| % Multicycloparaffins | 0.0 | 0.0 | 0.2 |
| Total | 100.0 | 100.0 | 100.0 |

Of the different saturated hydrocarbons found in lubricant base oils, traditionally paraffins have been considered more stable than cycloparaffins (naphthenes) toward oxidation, and therefore, more desirable. However, when the amount of aromatics in the base oil is less than 1 weight %, the most effective way to further improve oxidation stability is to increase the viscosity index of the base oil. Fischer-Tropsch derived lubricant base oils typically contain less than 1% aromatics. Due to their extremely low amount of aromatics and multi-ring cycloparaffins in the Fischer-Tropsch derived lubricant base oils of the present invention, their high oxidation stability far exceeds that of conventional lubricant base oils. Additionally, Fischer-Tropsch derived lubricant base oils are generally classified as API Group III base oils and have a low sulfur content of less than 5 ppm, a saturates content of greater than 95%, a high viscosity index, and excellent cold flow properties.

The Fischer-Tropsch derived lubricant base oils useful in this invention have high viscosity indexes. Viscosity index is measured by ASTM D 2270-93(98). Generally, they have a viscosity index greater than 120, preferably an amount calculated by the equation: Viscosity Index=28×Ln(Kinematic Viscosity at 100° C.)+95, more preferably greater than an amount calculated by the equation: Viscosity Index=28×Ln (Kinematic Viscosity at 100° C.)+105.

Blended Lubricant Base Oils

The blended lubricant base oils of the present invention comprise ≧70 weight % Fischer-Tropsch derived lubricant base oil and at least one polyalphaolefin lubricant base oil having a kinematic viscosity at 100° C. greater than about 30 cSt and less than 150 cSt. The blended lubricant base oil preferably comprises the at least one Fischer-Tropsch derived lubricant base oil in an amount between 70 and about 99 weight % and the at least one polyalphaolefin in an amount between about 1 and 30 weight %. The blended lubricant base oil may be made by blending the Fischer-Tropsch derived lubricant base oil and the polyalphaolefin lubricant base oil by techniques known to those of skill in the art.

The Fischer-Tropsch derived lubricant base oils have a kinematic viscosity at 100° C. between about 2 cSt and about 20 cSt, preferably between about 2 cSt and about 12 cSt. Preferably, the difference in the kinematic viscosities at 100° C. of the Fischer-Tropsch derived lubricant base oil and the polyalphaolefin lubricant base oil is greater than 40 cSt and more preferably is greater than 70 cSt.

To provide the blended finished lubricants, the blended lubricant base oil is mixed with at least one antiwear additive. The blended finished lubricant may be made by blending the blended lubricant base oil and the anti-wear additive by techniques known to those of skill in the art. The blended finished lubricant components may be blended in a single step going from the individual components (i.e., the Fischer-Tropsch derived lubricant base oil, the polyalphaolefin lubricant base oil, and the anti-wear additive) directly to provide the blended finished lubricant. In the alternative, the Fischer-Tropsch derived lubricant base oil and the polyalphaolefin lubricant base oil may initially be blended to provide the blended lubricant and then the blended lubricant, as such, may be mixed with the anti-wear additive. The blended lubricant may be isolated as such or the addition of the anti-wear additive may occur immediately.

The Fischer-Tropsch derived lubricant base oils used in the blended lubricant base oils and blended finished lubricants of the present invention may be manufactured at a site different from the site at which the components of the blended lubricant are received and blended. In addition, the blended finished lubricant may be manufactured at a site different from the site at which the components of the blended lubricant base oil are received and blended. Preferably, the blended lubricant base oil and the blended finished lubricant are made at the same site, which site is different from the site at which the Fischer-Tropsch derived lubricant base oil is originally made. Accordingly, the Fischer-Tropsch derived lubricant base oil is manufactured as a first site and shipped to a second remote site. The second remote site receives the Fischer-Tropsch derived lubricant base oil, the polyalphaolefin, and the additives, and the blended finished lubricant is manufactured at this second site.

Blended Finished Lubricant

Finished lubricants comprise at least one lubricant base oil and at least one additive. Lubricant base oils are the most important component of finished lubricants, generally comprising ≧70% of the finished lubricants. The finished lubricants of the present invention may be used in automobiles, diesel engines, axles, transmissions, and industrial applications.

The blended finished lubricants of the present invention comprise at least one Fischer-Tropsch derived lubricant base oil comprising ≧6 weight % molecules with monocycloparaffinic functionality and less than 0.05 weight% molecules with aromatic functionality; at least one polyalphaolefin lubricant base oil having a kinematic viscosity greater than about 30 cSt and less than 150 cSt, and an effective amount of at least one antiwear additive. The blended finished lubricants of the present invention exhibit exceptional friction and wear properties.

In general, the effective amount of anti-wear additive needed in a finished lubricant comprising a Fischer-Tropsch derived lubricant base oil is less than that required in a finished lubricant comprising a conventional petroleum lubricant base oil or a polyalphaolefin lubricant base oil. According to the present invention, it has been surprising discovered that significantly less anti-wear additive is required for a finished lubricant comprising a Fischer-Tropsch derived lubricant base oil comprising ≧6 weight % molecules with monocycloparaffinic functionality and less than 0.05 weight% molecules with aromatic functionality blended with a polyalphaolefin lubricant base oil having a kinematic viscosity at 100° C. greater than about 30 cSt and less than 150 cSt than in a finished lubricant comprising a Fischer-Tropsch derived lubricant base oil in the absence of a polyalphaolefin lubricant base oil. Accordingly, in the blended finished lubricants of the present invention, a reduced amount of anti-wear additive is needed. Thus, the blended lubricants of the present invention can be used to make high quality engine oils and other finished lubricants meeting the most stringent modern engine oil specifications.

An effective amount of at least one anti-wear additive means the amount of anti-wear additive in an additive package or individually added to the blended lubricant base oil to provide a blended finished lubricant with an HFRR wear volume with 1,000 g applied load of less than 300,000 microns$^3$, preferably less than 170,000 microns$^3$, more preferably less than 150,000 microns$^3$. Even more preferably, the blended finished lubricant has an HFRR wear volume with 1,000 g applied load of less than 110,000 microns$^3$. According to the present invention, preferably an effective amount of at least one anti-wear additive is between about 0.001 and 5 weight % of the blended finished lubricant. The effective amount of anti-wear additive in the blended finished lubricants of the present invention is less than the effective amount of anti-wear additive required in a lubricant comprising a Fischer-Tropsch derived lubricant base oil in the absence of a polyalphaolefin lubricant base oil and a polyalphaolefin lubricant base oil in the absence of a Fischer-Tropsch derived lubricant base oil.

Antiwear additives react chemically with metal surfaces in equipment being lubricated to form a layer that reduces wear at either low-medium temperatures and loads or high-temperatures and loads. Typically the metal surfaces comprise a ferrous alloy. The anti-wear additive may be one or more metal phosphates, metal dithiophosphates, metal dialkyldithiophosphates, metal thiocarbamates, metal dithiocarbamates, metal dialkyldithiocarbamates, ethoxylated amine dialkyldithiophosphates, ethoxylate amine dithiobenzoates, neutral organic phosphites, organo-molybdenum compounds, organo-sulfur compounds, sulfur compounds, chlorine compounds, or mixtures thereof. Preferably, the antiwear additive is a metal dialkyldithiophosphate and even more preferably, the metal is zinc. An overview of different types of antiwear additives is given by McDonald, R. A. and Phillips, W. D., "Lubricant Additives Chemistry and Applications," Chapters 2 & 3, 2003.

The blended finished lubricants of the present invention may further comprise additional additives such as EP agents, detergents, dispersants, antioxidants, pour point depressants, viscosity index improvers, ester co-solvents, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and combinations thereof.

When viscosity index improvers are added, preferably they are present in an amount less than 8 weight percent, and when ester co-solvents are added, preferably they are present in an amount less than 3 weight percent. Even more preferably, the finished lubricants according to the present invention do not comprise a viscosity index improver or an ester co-solvent. Preferably, the blended finished lubricants of the present invention have a viscosity index of greater than 140, more preferably greater than 165, without use of any viscosity index improver.

The finished lubricants of the present invention may be formulated to be a multigrade internal combustion engine crankcase oil, a transmission oil, a power train fluid, a turbine oil, a compressor oil, a hydraulic oil, or a grease. In one embodiment, the blended finished lubricant is a multigrade internal combustion engine crankcase oil meeting SAE J300, June 2001, specifications. In one specific embodiment, the blended finished lubricant is a multigrade internal combustion engine crankcase oil meeting the specifications for an engine oil having a viscosity grade of 0 W-20, 5 W-XX, 10 W-XX, or 15 W-XX wherein XX is 20, 30, 40, 50 or 60. In another embodiment, the blended finished lubricant is an internal combustion engine crankcase oil meeting the specifications for at least one ACEA 2002 European Oil Sequences for gasoline, light duty diesel engines, or heavy duty diesel engines.

The multigrade internal combustion engine crankcase oil according to the present invention preferably exhibits a TEOST-MHT total deposit weight of less than or equal to about 45 milligrams.

Surprisingly, the blended finished lubricants of the present invention exhibit exceptional friction and wear properties while requiring reduced amounts of anti-wear additives.

The blended finished lubricants of the present invention reduce wear in equipment made of ferrous alloys. Ferrous alloys are alloys of iron, containing various amounts of carbon, manganese, and one or more other elements, such as sulfur, nickel, silicon, phosphorus, chromium, molybdenum, and vanadium. These elements, when combined with iron, form different types of steels with varying properties. Antiwear additives are designed to react with the metal surfaces, usually of ferrous alloys, to reduce wear when the asperities on the surfaces come in contact with each other.

When the blended finished lubricant is formulated to be a multigrade internal combustion engine crankcase oil, an internal combustion engine comprising a valve train may be operated by operating the engine using fuel and lubricating the engine using the blended finished lubricant of the presently claimed invention. The engine may be a compression ignition engine, or more specifically a compression ignition engine equipped with an exhaust gas after treatment device. The engine may be a spark ignition engine, or more specifically a spark ignition engine equipped with an exhaust gas after treatment device. The engine may further be quipped with a turbocharger. The fuel may be a diesel fuel, a low sulfur diesel fuel, a gasoline fuel, an unleaded gasoline, or natural gas.

EXAMPLES

The invention will be further explained by the following illustrative examples that are intended to be non-limiting.

Example 1

Fischer-Tropsch Wax and Preparation of Fischer-Tropsch Derived Lubricant Base Oils Two samples of hydrotreated Fischer-Tropsch wax, FT Wax A and FT Wax B, were made using a Co-based Fischer-Tropsch catalyst. Both samples were analyzed and found to have the properties shown in Table V.

TABLE V

| Fischer-Tropsch Wax | | |
|---|---|---|
| Fischer-Tropsch Catalyst | Co-Based | Co-Based |
| Fischer-Tropsch Wax | FT Wax A | FT Wax B |
| Sulfur, ppm | <6 | 7, <2 |
| Nitrogen, ppm | 6, 5 | 12, 19* |
| Oxygen by NA, Wt % | 0.59 | 0.69 |
| GC N-Paraffin Analysis | | |
| Total N Paraffin, Wt % | 84.47 | 83.72 |
| Avg. Carbon Number | 27.3 | 30.7 |
| Avg. Molecular Weight | 384.9 | 432.5 |
| D-6352 SIMDIST TBP (WT %), ° F. | | |
| $T_{0.5}$ | 515 | 129 |
| $T_5$ | 597 | 568 |
| $T_{10}$ | 639 | 625 |
| $T_{20}$ | 689 | 674 |
| $T_{30}$ | 714 | 717 |
| $T_{40}$ | 751 | 756 |
| $T_{50}$ | 774 | 792 |
| $T_{60}$ | 807 | 827 |
| $T_{70}$ | 839 | 873 |
| $T_{80}$ | 870 | 914 |
| $T_{90}$ | 911 | 965 |
| $T_{95}$ | 935 | 1005 |
| $T_{99.5}$ | 978 | 1090 |
| $T_{90}$-$T_{10}$, ° C. | 133 | 171 |
| Wt % $C_{30+}$ | 34.69 | 40.86 |
| Wt % $C_{60+}$ | 0.00 | 0.00 |
| $C_{60+}/C_{30+}$ | 0.00 | 0.00 |

*The results with more than one value are duplicate test results.

The Fischer-Tropsch syncrudes had a weight ratio of compounds having at least 60 carbons atoms to compounds having at least 30 carbon atoms of less than 0.18 and a $T_{90}$ boiling point between 900° F. and 1000° F. Three samples of the Fischer-Tropsch waxes (one sample of FT Wax A and two samples of FT Wax B) were hydroisomerized over a Pt/SSZ-32 catalyst or Pt/SAPO-11 catalyst on an alumina binder. Operating conditions included temperatures between 652° F. and 695° F., LHSVs of 0.6 to 1.0 $hr^{-1}$, reactor pressure of 1000 psig, and once-through hydrogen rates of between 6 and 7 MSCF/bbl. The reactor effluent passed directly to a second reactor containing a Pt/Pd on silica-alumina hydrofinishing catalyst also operated at 1000 psig. Conditions in the second reactor included a temperature of 450° F. and an LHSV of 1.0 $hr^{-1}$.

The products boiling above 650° F. were fractionated by atmospheric or vacuum distillation to produce distillate fractions of different viscosity grades. Three Fischer-Tropsch derived lubricant base oils were obtained: FT-4A (from FT Wax A), and FT-4B and FT-8B (both from FT Wax B). Test data on specific distillate fractions useful as the Fischer-Tropsch derived lubricant base oil are shown below in Table VI.

TABLE VI

| Properties of Fischer-Tropsch derived lubricant base oils | | | |
|---|---|---|---|
| Properties | FT-4A | FT-4B | FT-8B |
| Hydroisomerization Temperature, ° F. | 672 | 700 | 694 |
| Hydroisomerization Dewaxing Catalyst | Pt/SAPO-11 | Pt/SAPO-11 | Pt/SAPO-11 |
| Reactor Pressure, psig | 1000 | 1000 | 1000 |
| Viscosity at 100° C., cSt | 3.94 | 4.415 | 7.953 |
| Viscosity Index | 143 | 147 | 165 |
| Aromatics, Wt % | 0.004 | 0.008 | 0.006 |

TABLE VI-continued

| Properties of Fischer-Tropsch derived lubricant base oils | | | |
|---|---|---|---|
| Properties | FT-4A | FT-4B | FT-8B |
| FIMS, Wt % of Molecules | | | |
| Paraffins | 89.0 | 89.1 | 87.2 |
| Monocycloparaffins | 11.0 | 10.9 | 12.6 |
| Multicycloparaffins | 0.0 | 0.0 | 0.2 |
| Total | 100.0 | 100.0 | 100.0 |
| API Gravity | 42.0 | 41.6 | 39.62 |
| Pour Point, ° C. | −19 | −12 | −12 |
| Cloud Point, ° C. | −9 | −8 | +13 |
| Ratio of Mono/Multicycloparaffins | >100 | >100 | 61 |
| Ratio of Pour Point/Vis100 (SMA consider removing) | −4.82 | −2.72 | −1.51 |
| Base Oil Pour Factor | −7.92 | −7.09 | −2.76 |
| Oxidator BN, Hours | No data | 41.35 | No data |
| Noack Volatility, Wt % | 14.6 | 10.89 | 2.72 |
| CCS Viscosity @ −35C, cP | 1611 | 2079 | 13627 |

The ratio of pour point and kinematic viscosity at 100° C. is merely the pour point in ° C. divided by the kinematic viscosity at 100° C. The Base Oil Pour Factor is an empirical number calculated by the following equation:

Base Oil Pour Factor=7.35×*Ln*(Kinematic Viscosity at 100° C.)−18, wherein *Ln*(Kinematic Viscosity at 100° C.) is the natural logarithm with base "*e*" of Kinematic Viscosity at 100° C. in cSt.

Example 2

Preparation of Blended Finished Lubricants

The Fischer-Tropsch derived lubricant base oils prepared above (FT-4A, FT-4B, and FT-8B) were used to make the blended finished lubricants.

Several PAOs of varied kinematic viscosities at 100° C. were also used to make the blended finished lubricants. The PAOs used were as follows: Chevron Phillips PAO-4, PAO-8, and PAO-25; Durasyn® 174 PAO-40 (Durasyn® is a registered trademark of Amoco Chemical Company); and Mobil SHF-1003 PAO-100. The number in the PAO identifications (i.e., PAO-100) represents the kinematic viscosities of the PAO at 100° C., in cSt.

Blends containing both Fischer-Tropsch derived lubricant base oil and high viscosity PAO (PAO-40 or PAO-100) were formulated into engine oils using a standard passenger car with Detergent-Inhibitor (DI) additive package and a pour point depressant (PPD). No viscosity index improver was added to the blends, as the viscosity indexes were already very high, and therefore, it was not necessary to add any viscosity index improvers. Friction and wear measurements were made on the test oils using an HFRR, with low HFRR friction coefficients generally correlated with good fuel economy. Test results on these blends are shown in Table VII.

TABLE VII

| Very Low Wear Blends of FTBO and High Viscosity PAO | | |
|---|---|---|
| Description | 0W-20 | 10W-30 |
| Wt % FT-4A | 73.36 | 0 |
| Wt % FT-8B | 0 | 78.5 |
| Wt % Mobil SHF-1003 PAO-100 | 0 | 10.85 |

TABLE VII-continued

Very Low Wear Blends of FTBO and High Viscosity PAO

| Description | 0W-20 | 10W-30 |
|---|---|---|
| Wt % Durasyn ® 174 PAO-40 | 15.99 | 0 |
| Wt % DI Additive Package | 10.35 | 10.35 |
| Wt % PPD | 0.3 | 0.3 |
| CCS (cP) | 4100 at −35° C. | 6360 at −25° C. |
| Viscosity at 100° C. (cSt) | 7.093 | 12.54 |
| Viscosity Index | 170 | 172 |
| Noack Volatility (Weight %) | 14.36 | 3.65 |
| MRV (cP) | 8,442 at −40° C. | 228,879-YS at −30° C. |
| Oxidator B, L-4 Catalyst (Hours) | Not tested | 30.04 |
| HTHS at 150° C. (cP) | 2.22 | 3.93 |
| TEOST MHT (mg) | 33.3 | 54.2 |
| HFRR Friction Coefficient | 0.111 | 0.104 |
| HFRR Wear Volume Below the Plane (Microns$^3$) | 148,645 | 109,779 |
| HFRR Net Wear Volume (Microns$^3$) | −1,600 | 20,086 |

YS refers to the presence of yield stress in the MRV test.

The above data demonstrated low wear, as well as excellent oxidation stability (Oxidator B with L-4 Catalyst) of blends of ≧70 wt % Fischer-Tropsch derived lubricant base oils with ≧6 weight % molecules with monocycloparaffinic functionality (FT-4A and FT-8B) and high viscosity PAO (PAO-40 and PAO-100). The blend with the lowest HFRR coefficient of friction and lowest HFRR Wear Below the Plane was a blend of ≧70 wt % Fischer-Tropsch derived lubricant base oil with ≧6 weight % molecules with monocycloparaffinic functionality and high viscosity PAO, where the difference in the kinematic viscosities at 100° C. between the Fischer-Tropsch derived lubricant base oil and PAO was greater than 70 cSt.

By comparison, as can be seen in Table VIII, blends of ≦70 wt % Fischer-Tropsch derived lubricant base oils with ≧6 weight % molecules with monocycloparaffinic functionality (FT-4A or FT-4B) with either low viscosity PAO (PAO-8 and PAO-25) or high viscosity PAO (PAO-100), exhibited excellent friction and wear properties, but did not demonstrate the enhanced friction and wear benefits seen with blends of the present invention containing ≧70 wt % Fischer-Tropsch derived lubricant base oil and PAO having a kinematic viscosity at 100° C. greater than about 30 cSt and less than 150 cSt (PAO-40 and PAO-100).

TABLE VIII

Comparison Blends of FT and PAO

| Description | 0W-20 | 0W-20 | 5W-30 |
|---|---|---|---|
| Wt % FT-4A | 31.83 | 69.87 | 0 |
| Wt % FT-4B | 0 | 0 | 66.15 |
| Wt % Chevron Phillips PAO-8 | 57.52 | 0 | 0 |
| Wt % Chevron Phillips PAO-25 | 0 | 19.47 | 0 |
| Wt % Mobil SHF-1003 PAO-100 | 0 | 0 | 23.2 |
| Wt % DI Additive Package | 10.35 | 10.35 | 10.35 |
| Wt % PPD | 0.3 | 0.3 | 0.3 |
| CCS (cP) | 5534 at −35° C. | 3876 at −35° C. | 5993 at −30° C. |
| Viscosity at 100° C. (cSt) | 7.555 | 6.981 | 11.32 |
| Viscosity Index | 145 | 169 | 161 |
| Noack Volatility (Weight %) | 7.19 | 13.77 | 9.6 |
| MRV (cP) | 11,768 at −40° C. | 9,600 at −40° C. | 13,207 at −35° C. |

TABLE VIII-continued

Comparison Blends of FT and PAO

| Description | 0W-20 | 0W-20 | 5W-30 |
|---|---|---|---|
| Oxidator B, L-4 Catalyst (Hours) | 28.82 | Not tested | 23.29 |
| HTHS at 150° C. (cP) | 2.32 | 2.41 | 3.58 |
| TEOST MHT (mg) | 28.7 | 25.9 | 28.5 |
| HFRR Friction Coefficient | 0.116 | 0.115 | 0.111 |
| HFRR Wear Volume Below the Plane (Microns$^3$) | 187,885 | 182,030 | 172,120 |
| HFRR Net Wear Volume (Microns$^3$) | 55,510 | 35,960 | 29,425 |

Two 0 W-20 blends, one with an all-FTBO formulation and one with an all-PAO formulation, were made. HFRR wear tests were done on these blends for comparison. The test 10 results on these samples are shown in Table IX.

TABLE IX

Comparison Blends of All-FTBO and All-PAO

| Description | All-FTBO 0W-20 | All-PAO 0W-20 |
|---|---|---|
| Wt % FT-4B | 53.74 | 0 |
| Wt % FT-8B | 35.61 | 0 |
| Wt % Chevron Phillips PAO-4 | 0 | 31.83 |
| Wt % Chevron Phillips PAO-8 | 0 | 57.52 |
| Wt % DI Additive Package | 10.35 | 10.35 |
| Wt % PPD | 0.3 | 0.3 |
| CCS (cP) | 5660 at −35° C. | 5534 at −35° C. |
| Viscosity at 100° C. (cSt) | 7.09 | 7.555 |
| Viscosity Index | 167 | 145 |
| Noack Volatility (Weight %) | 8.86 | 7.19 |
| MRV (cP) | Fail (71,156 at −40° C.) | 11,768 at −40° C. |
| Oxidator B, L-4 Catalyst (Hours) | 28.7 | 28.82 |
| HTHS at 150° C. (cP) | 2.36 | 2.3 |
| TEOST MHT (mg) | 40 | 28.7 |
| HFRR Friction Coefficient | 0.110 | 0.116 |
| HFRR Wear Volume Below the Plane (Microns$^3$) | 170,340 | 180,560 |
| HFRR Net Wear Volume (Microns$^3$) | 30,190 | 38,975 |

While these comparison results demonstrated that all-Fischer-Tropsch derived lubricant base oil blends give better frictional properties and lower wear than all-PAO blends, it was found that a blend of the same viscosity grade, 0 W-20, comprised of a mixture of ≧70 wt % Fischer-Tropsch derived lubricant base oil and higher viscosity PAO (PAO-100), had significantly lower wear than the all-Fischer-Tropsch derived lubricant base oil blend. It was surprising that the blends having the mixture of ≧70 wt % Fischer-Tropsch lubricant base oil and high viscosity PAOs gave reductions in HFRR Wear Volume Below the Plane of 12.7% (0 W-20) and 35.6% (10 W-30).

While the present invention has been described with reference to specific embodiments, this application is intended to cover those various changes and substitutions that may be made by those of ordinary skill in the art without departing from the spirit and scope of the appended claims.

What is claimed is:

1. A process for making a blended lubricant base oil comprising:

a. synthesizing at least one Fischer-Tropsch derived lubricant base oil comprising ≧6 weight % molecules with monocycloparaffinic fuictionality and less than 0.05 weight % molecules with aromatic functionality;

b. providing at least one polyalphaolefin lubricant base oil with a kinematic viscosity at 100° C. greater than about 30 cSt and less than 150 cSt; and c. blending the at least one Fischer-Tropsch derived lubricant base oil and the at least one polyalphaolefin lubricant base oil.

2. The process of claim 1, wherein the at least one Fischer-Tropsch derived lubricant base oil comprises a weight percent of molecules with cycloparaffinic functionality of greater than 10, and a ratio of weight percent of molecules with monocycloparaffinic functionality to weight percent of molecules with multicycloparaffinic functionality greater than 15.

3. The process of claim 1, wherein the at least one Fischer-Tropsch derived lubricant base oil comprises a weight percent of molecules with aromatic functionality less than 0.01.

4. The process of claim 1, wherein the at least one Fischer-Tropsch derived lubricant base oil comprises ≧10 weight % of molecules with monocycloparaffinic functionality.

5. The process of claim 1, wherein the difference in the kinematic viscosities at 100° C. of the Fischer-Tropsch derived lubricant base oil and the polyalphaolefin lubricant base oil is greater than 40 cSt.

6. The process of claim 1, wherein the difference in the kinematic viscosities at 100° C. of the Fischer-Tropsch derived lubricant base oil and the polyalphaolefin lubricant base oil is greater than 70 cSt.

7. A process for making a blended finished lubricant comprising:

a. performing a Fischer-Tropsch synthesis to provide a product stream;

b. isolating from the product stream a substantially paraffinic wax feed;

c. hydroisomerizing the substantially paraffinic wax feed using a shape selective intermediate pore size molecular sieve comprising a noble metal hydrogenation component under conditions of about 600° F. to 750° F.;

d. isolating an isomerized oil;

e. hydrofinishing the isomerized oil to provide a Fischer-Tropsch derived lubricant base oil comprising ≧6 weight % molecules with monocycloparaffinic functionality and less than 0.05 weight % molecules with aromatic functionality;

f. providing at least one polyalphaolefin lubricant base oil having a kinematic viscosity at 100° C. greater than 30 cSt and less than 150 cSt; and g. blending the at least one Fischer-Tropsch derived lubricant base oil, the at least one polyalphaolefin lubricant base oil, and an effective amount of at least one anti-wear additive to provide a blended finished lubricant.

8. The process of claim 7, wherein the at least one Fischer-Tropsch derived lubricant base oil comprises a weight percent of molecules with aromatic functionality of less than 0.05, a weight percent of molecules with cycloparaffinic functionality of greater than 10, and a ratio of weight percent of molecules with monocycloparaffinic functionality to weight percent of molecules with multicycloparaffinic functionality greater than 15.

9. The process of claim 7, wherein the at least one Fischer-Tropsch derived lubricant base oil comprises a weight percent of molecules with aromatic functionality less than 0.01.

10. The process of claim 7, wherein the at least one Fischer-Tropsch derived lubricant base oil comprises ≧8 weight % molecules with monocycloparaffinic functionality.

11. The process of claim 7, wherein the at least one Fischer-Tropsch derived lubricant base oil comprises ≧10 weight % molecules with monocycloparaffinic functionality.

12. The process of claim 7, wherein the blended finished lubricant comprises ≧70 weight % Fischer-Tropsch derived lubricant base oil, 1 to 30 weight % polyalphaolefin lubricant base oil, and 0.001 and 5 weight % anti-wear additive.

13. The process of claim 7, wherein the blended finished lubricant has a kinematic viscosity between about 2.0 and 20 cSt at 100° C.

14. The process of claim 7, wherein the blended finished lubricant has a Noack volatility of less than 12 weight %.

15. The process of claim 7, wherein the blended finished lubricant has an Oxidator B with L-4 Catalyst test result of greater than 22 hours.

16. The process of claim 7, wherein the blended finished lubricant has a TEOST-MHT total deposit weight of less than or equal to about 45 milligrams.

17. The blended finished lubricant of claim 7, wherein the blended finished lubricant exhibits an HFRR Wear Volume Below the Plane of less than or equal to 300,000 cubic microns.

18. The process of claim 7, wherein the at least one anti-wear additive is selected from the group consisting of metal phosphates, metal dithiophosphates, metal dialkyldithiophosphates, metal thiocarbamates, metal dithiocarbamates, metal dialkyldithiocarbamates, ethoxylated amine dialkyldithiophosphates, ethoxylate amine dithiobenzoates, neutral organic phosphites, organo-molybdenum compounds, organo-sulfur compounds, sulfur compounds, chlorine compounds, and mixtures thereof.

19. The process of claim 7, further comprising adding at least one additional lubricant additive selected from the group consisting of EP agents, detergents, dispersants, antioxidants, pour point depressants, viscosity index improvers, ester co-solvents, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and mixtures thereof.

20. The process of claim 7, wherein the noble metal hydrogenation component is platinum, palladium, or combinations thereof.

21. The process of claim 7, wherein the shape selective intermediate pore size molecular sieve is selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof.

22. The process of claim 7, wherein the effective amount of at least one anti-wear additive is less than the effective amount of anti-wear additive in a finished lubricant comprising Fischer-Tropsch derived lubricant base oil in the absence of a polyalphaolefin lubricant base oil.

23. The process of claim 7, wherein the effective amount of at least one anti-wear additive is less than the effective amount of anti-wear additive in a finished lubricant comprising polyalphaolefin lubricant base oil in the absence of a Fischer-Tropsch derived lubricant base oil.

24. The process of claim 7, further comprising solvent dewaxing the isomerized oil.

25. A process for manufacturing a blended finished lubricant including first site and second site remote from the first site, the process comprising:

a. manufacturing at the first site at least one Fischer-Tropsch derived lubricant base oil comprising ≧6 weight % molecules with monocycloparaffinic functionality and less than 0.05 weight % molecules with aromatic functionality;

b. receiving the Fischer-Tropsch derived lubricant base oil at the second site remote from the first site; and c. blending the Fischer-Tropsch derived lubricant base oil with at least one polyalphaolefin lubricant base oil having a kinematic viscosity at 100° C. greater than 30 and less than 150 and an effective amount of at least one anti-wear additive.

* * * * *